US009702611B2

(12) United States Patent
Kang et al.

(10) Patent No.: US 9,702,611 B2
(45) Date of Patent: Jul. 11, 2017

(54) REFRIGERATOR WITH STERILIZER

(75) Inventors: Sung Cheol Kang, Gwangju (KR); Eui Young Chang, Anyang-si (KR); Seong Wook Jeong, Gwangju-si (KR); Jae Koog An, Gwangju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 181 days.

(21) Appl. No.: 13/366,732

(22) Filed: Feb. 6, 2012

(65) Prior Publication Data

US 2012/0204581 A1 Aug. 16, 2012

(30) Foreign Application Priority Data

Feb. 11, 2011 (KR) ..... 10-2011-0012499

(51) Int. Cl.

| | |
|---|---|
| ***F24F 3/16*** | (2006.01) |
| ***F25D 17/06*** | (2006.01) |
| ***F25D 21/00*** | (2006.01) |
| ***F24F 3/14*** | (2006.01) |
| ***F25D 17/04*** | (2006.01) |
| *F25D 21/08* | (2006.01) |

(52) U.S. Cl.

CPC ..... *F25D 17/062* (2013.01); *F24F 3/14* (2013.01); *F25D 17/042* (2013.01); *F25D 21/00* (2013.01); *F25B 2700/02* (2013.01); *F25D 21/002* (2013.01); *F25D 21/08* (2013.01); *F25D 2317/041* (2013.01); *F25D 2317/0415* (2013.01); *F25D 2700/02* (2013.01)

(58) Field of Classification Search

CPC ..... F25B 17/042; F25B 2317/0415; F25B 2700/02; F24F 3/14; F25D 21/00; F25D 2317/0415; F25D 17/042

USPC ..... 62/78, 176.2, 153

See application file for complete search history.

(56) References Cited

U.S. PATENT DOCUMENTS

| | | | | |
|---|---|---|---|---|
| 4,662,186 | A * | 5/1987 | Park | 62/265 |
| 5,078,971 | A * | 1/1992 | Matuda | A61L 9/16 261/DIG. 88 |
| 5,230,220 | A * | 7/1993 | Kang et al. | 62/78 |
| 5,346,299 | A * | 9/1994 | Werkmeister | F25D 23/04 312/405.1 |
| 2003/0024254 | A1 * | 2/2003 | Yoshida et al. | 62/78 |

(Continued)

FOREIGN PATENT DOCUMENTS

| | | |
|---|---|---|
| CN | 1400445 | 3/2003 |
| CN | 1991280 | 7/2007 |

(Continued)

OTHER PUBLICATIONS

Chinese Office Action dated Mar. 9, 2015 in Chinese Patent Application No. 201210031642.9.

(Continued)

*Primary Examiner* — David Teitelbaum
(74) *Attorney, Agent, or Firm* — Staas & Halsey LLP

(57) ABSTRACT

A refrigerator which variably controls operation of a sterilizer according to variation in humidity within the refrigerator to improve sterilizing capacity includes a control unit to drive the sterilizer while repeatedly turning the cold air circulation fan on/off during a refrigerating cycle in which the defrosting heater is not operated, and stop driving the sterilizer during operation of the defrosting heater.

10 Claims, 8 Drawing Sheets

(56) References Cited

U.S. PATENT DOCUMENTS

| | | | | |
|---|---|---|---|---|
| 2006/0168980 | A1* | 8/2006 | Pastor | F25D 23/006 62/264 |
| 2007/0107452 | A1* | 5/2007 | Kim et al. | 62/264 |
| 2007/0266725 | A1* | 11/2007 | Anikhindi et al. | 62/317 |
| 2008/0148734 | A1* | 6/2008 | Althaus et al. | 60/650 |
| 2008/0168790 | A1* | 7/2008 | Hurlebaus et al. | 62/331 |
| 2009/0241561 | A1* | 10/2009 | Han et al. | 62/80 |

FOREIGN PATENT DOCUMENTS

| | | |
|---|---|---|
| JP | 2005-42989 | 2/2005 |
| KR | 10-2006-0011061 | 2/2006 |
| WO | 2005/115177 | 12/2005 |
| WO | 2005/124251 | 12/2005 |
| WO | 2010/024078 | 3/2010 |
| WO | 2010/074162 | 7/2010 |

OTHER PUBLICATIONS

Korean Office Action dated Sep. 19, 2016 in Korean Patent Application No. 10-2011-0012499.
Chinese Office Action dated May 24, 2016 in Chinese Patent Application No. 201210031642.9.
Chinese Office Action dated Dec. 2, 2016 in Chinese Patent Application No. 201210031642.9.
Korean Office Action dated Mar. 29, 2017 in Korean Patent Application No. 10-2011-0012499.

* cited by examiner

REFRIGERATOR WITH STERILIZER

CROSS-REFERENCE TO RELATED APPLICATIONS

This application claims the priority benefit of Korean Patent Application No. 2011-0012499, filed on Feb. 11, 2011 in the Korean Intellectual Property Office, the disclosure of which is incorporated herein by reference.

BACKGROUND

1. Field

Embodiments relate to a refrigerator with a sterilizer to sterilize and deodorize.

2. Description of the Related Art

In general, a refrigerator is an apparatus which stores food in a fresh state for a long time using cold air having exchanged heat with evaporators. Such a refrigerator includes storage chambers including a refrigerating chamber and a freezing chamber, evaporators provided at the rear portions of the storage chambers to generate cold air, and cold air supply devices, each of which includes a duct and a fan to circulate the cold air generated from the evaporators. The cold air supplied to the storage chambers through the cold air supply devices is circulated to maintain proper temperatures of the storage chambers.

The refrigerator executes a refrigerating operation to supply cold air to the storage chambers and a defrosting operation to remove frost accumulated on the evaporators during the refrigerating operation. During the defrosting operation, the frost accumulated on the evaporators is evaporated by defrosting heaters, and thus humidity within the refrigerator is raised.

Recently, refrigerators with a sterilizer and a deodorizer to sterilize and deodorize the inside of the refrigerator have been developed. Such a sterilizer generates ions to perform sterilization of the inside of the refrigerator. In the case of the sterilizer executing sterilization through ion generation, an amount of the generated ions is maintained at or above a predetermined level. Such ion generation may be varied according to humidity around the sterilizer. When the amount of the ions generated from the sterilizer is lowered due to the variation of humidity during the refrigerating operation and the defrosting operation and does not remain above the predetermined level, the sterilizing capacity of the sterilizer is lowered.

SUMMARY

Additional aspects and/or advantages will be set forth in part in the description which follows and, in part, will be apparent from the description, or may be learned by practice of the invention.

Therefore, it is an aspect to provide a refrigerator which variably controls operation of a sterilizer according to variation in humidity within the refrigerator to improve sterilizing capacity.

It is another aspect to provide a refrigerator with a sterilizer which has improved efficiency of sterilizing capacity.

It is a further aspect to provide a refrigerator with a sterilizer which has improved convenience in use.

In accordance with one aspect, a refrigerator includes at least one storage chamber, an evaporator generating cold air to cool the at least one storage chamber, a cold air circulation fan to forcibly circulate the cold air generated by the evaporator, a defrosting heater to heat the evaporator to remove frost accumulated on the evaporator, a sterilizer installed in the at least one storage chamber to sterilize and deodorize the inside of the at least one storage chamber, and a control unit to drive the sterilizer while repeatedly turning the cold air circulation fan on/off during a refrigerating cycle in which the defrosting heater is not operated, and to stop driving of the sterilizer during operation of the defrosting heater.

The control unit may execute a section in which driving of the sterilizer is periodically or aperiodically stopped during operation of the sterilizer.

The control unit may continuously drive the sterilizer during the refrigerating cycle in which the defrosting heater is not operated.

The refrigerator may further include a door to open and close the at least one storage chamber and a door opening and closing sensing unit to sense whether or not the door is opened or closed.

The control unit may judge whether or not the door is opened or closed according to a sensing signal of the door opening and closing sensing unit, and stop driving of the sterilizer upon judging that the door is opened.

In accordance with another aspect, a refrigerator includes at least one storage chamber, an evaporator generating cold air to cool the at least one storage chamber, a cold air circulation fan to forcibly circulate the cold air generated by the evaporator, a defrosting heater to heat the evaporator to remove frost accumulated on the evaporator, a sterilizer installed in the at least one storage chamber to sterilize and deodorize the inside of the at least one storage chamber, and a control unit to drive the sterilizer while repeatedly turning the cold air circulation fan on/off during a refrigerating cycle in which the defrosting heater is not operated, and executes a section in which driving of the sterilizer is periodically or aperiodically stopped during operation of the sterilizer.

The control unit may stop driving of the sterilizer during operation of the defrosting heater.

The refrigerator may further include a door to open and close the at least one storage chamber and a door opening and closing sensing unit to sense whether or not the door is opened or closed.

The control unit may judge whether or not the door is opened or closed according to a sensing signal of the door opening and closing sensing unit, and stop driving of the sterilizer upon judging that the door is opened.

In accordance with a further aspect, a refrigerator includes at least one storage chamber, an evaporator generating cold air to cool the at least one storage chamber, a cold air circulation fan to forcibly circulate the cold air generated by the evaporator, a defrosting heater to heat the evaporator to remove frost accumulated on the evaporator, a sterilizer installed in the at least one storage chamber to sterilize and deodorize the inside of the at least one storage chamber, and a control unit to stop driving of the sterilizer during operation of the defrosting heater.

The control unit may drive the sterilizer while repeatedly turning the cold air circulation fan on/off during a refrigerating cycle in which the defrosting heater is not operated, and execute a section in which driving of the sterilizer is periodically or aperiodically stopped during operation of the sterilizer.

The refrigerator may further include a door to open and close the at least one storage chamber and a door opening and closing sensing unit to sense whether or not the door is opened or closed.

The control unit may judge whether or not the door is opened or closed according to a sensing signal of the door opening and closing sensing unit, and stop driving of the sterilizer upon judging that the door is opened.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
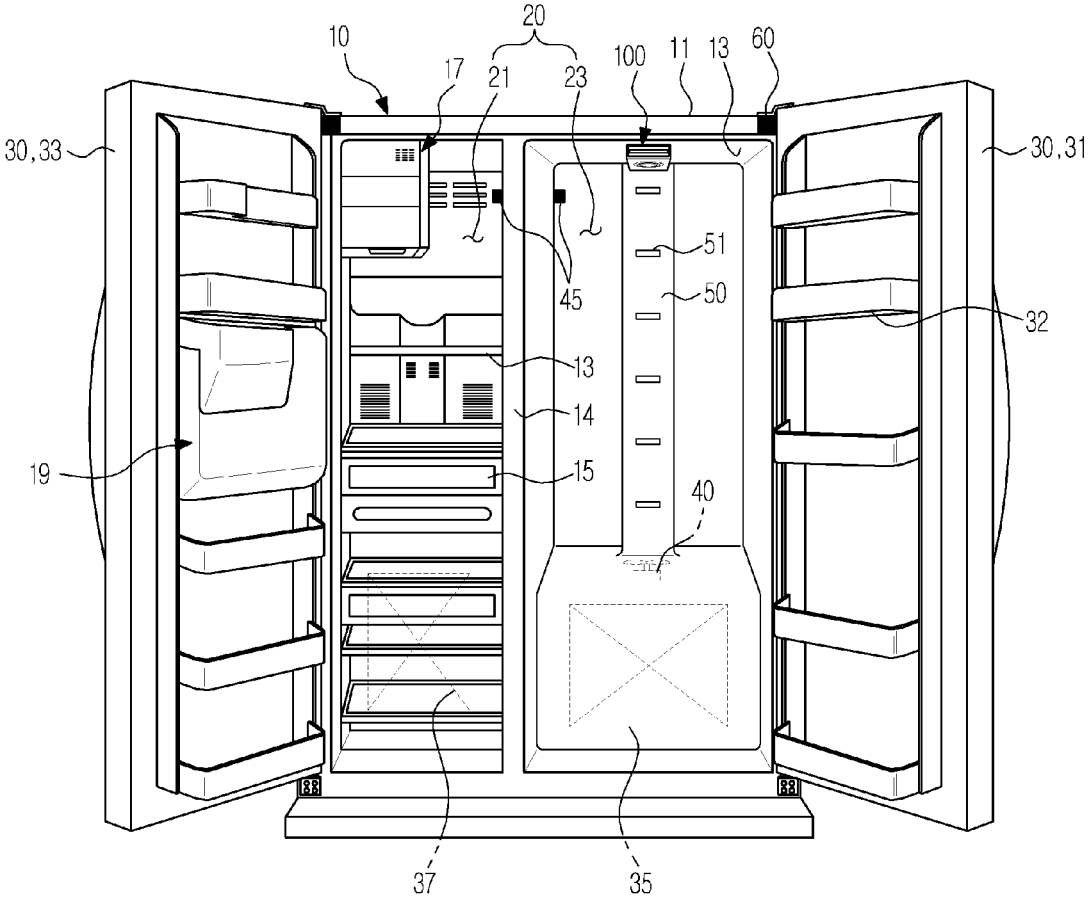
FIG. 1 is a perspective view of a refrigerator in accordance with one embodiment in a state in which doors are opened.

Reference will now be made in detail to the embodiments, examples of which are illustrated in the accompanying drawings, wherein like reference numerals refer to like elements throughout.

FIG. 1 is a perspective view of a refrigerator in accordance with one embodiment in a state in which doors are opened.

As shown in FIG. 1, the refrigerator in accordance with the embodiment includes a main body 10 forming the external appearance of the refrigerator and provided with storage chambers 20, and doors 30 installed on the main body 10 to open and close the storage chambers 20.

The main body 10 includes an outer case 11 forming the external appearance of the refrigerator, an inner case 13 separated from the outer case 11 by a designated interval and forming the storage chambers 20, and a foamed insulating material 12 provided between the outer case 11 and the inner case 13.

The storage chambers 20 include a refrigerating chamber 23 and a freezing chamber 21 divided from each other by a vertical diaphragm 11, and the doors 30 include a refrigerating chamber door 31 and a freezing chamber door 33 to respectively open and close the refrigerating chamber 23 and the freezing chamber 21.

A plurality of racks 13 on which food is placed and which are separated in the vertical direction, and a plurality of drawers 15 drawn into and taken out of the refrigerating chamber 23 and the freezing chamber 21 to accommodate food may be disposed in the refrigerating chamber 23 and the freezing chamber 21.

An ice maker 17 to generate ice may be provided at one side of the upper portion of the freezing chamber 21, and a dispenser 19 to dispense the ice generated by the ice maker 17 to the outside may be provided on the freezing chamber door 33. The dispenser 19 is a device to obtain ice or water at the outside without opening the doors 30.

A refrigerating chamber evaporator 35 and a freezing chamber evaporator 37 to generate cold air to cool the refrigerating chamber 23 and the freezing chamber 21 are installed at the rear portions of the refrigerating chamber 23 and the freezing chamber 21, and the cold air generated by the refrigerating chamber evaporator 35 and the freezing chamber evaporator 37 is respectively discharged to the refrigerating chamber 23 and the freezing chamber 21 through cold air supply devices.

Although the cold air supply devices are respectively provided in the refrigerating chamber 23 and the freezing chamber 21, the cold air supply devices have symmetrical structures, and thus only the cold air supply device installed in the refrigerating chamber 23 will be described.

Such a cold air supply device may include a cold air circulation fan 40 to forcibly circulate cold air generated by the refrigerating chamber evaporator 35, and a cold air duct 50 along which the cold air blown by the cold air circulation fan 40 flows.

The cold air duct 50 may be provided with a plurality of cold air discharge holes 51 separated from each other in the vertical direction to discharge cold air to the refrigerating chamber 23 and a cold air suction hole (not shown) to suck cold air having cooled the refrigerating chamber 23 to return the cold air to the refrigerating chamber evaporator 35. A damper (not shown) to adjust an amount of the cold air discharged to the refrigerating chamber 23 may be provided within the cold air duct 50.

Cold air generated by heat exchange with the refrigerating chamber evaporator 35 is discharged to the refrigerating chamber 23 through the cold air discharge holes 51 formed on the cold air duct 50 by the blowing force of the cold air circulation fan 40 to cool the refrigerating chamber 23, and the cold air having cooled the refrigerating chamber 23 is returned to the refrigerating chamber evaporator 35 through the air suction hole, thus being forcibly circulated.

Temperature sensing units 45 to sense temperatures of the insides of the refrigerating chamber 23 and the freezing chamber 21 may be respectively provided in the refrigerating chamber 23 and the freezing chamber 21.

A sterilizer 100 to sterilize and deodorize food stored in the refrigerating chamber 23 may be installed on the upper surface of the refrigerating chamber 23. The sterilizer 100 sucks air within the refrigerating chamber 23, generates ions, and supplies the generated ions to the refrigerating chamber 23 to remove germs, such as viruses, bacteria, mold, etc., contained in the air of the refrigerating chamber 23. Such a sterilizer 100 will be described in detail later.

Door guards 32 to accommodate food having a small size or bottles are provided on the inner surfaces of the refrigerating chamber door 31 and the freezing chamber door 33, and the refrigerating chamber door 31 and the freezing chamber door 33 are rotatably connected to both sides of the main body 10 to open and close the refrigerating chamber 23 and the freezing chamber 21.

An input unit 42 including buttons to receive operating signals (such as set temperatures, for example) input by a user and a display to display the operating state of the refrigerator may be provided on the doors 30. An operating signal selected by the input unit 42 is transmitted to a control unit 70 (with reference to FIG. 7) to control the overall operation of the refrigerator.

Door opening and closing sensing units 60 selectively contacting the doors 30 during opening or closing of the doors 30 to sense whether or not the doors 30 are opened or closed may be provided at both sides of the upper end of the main body 10.

The door opening and closing sensing units 60 are electrically connected to the control unit 70, and signals sensed by the door opening and closing sensing units 60 are transmitted to the control unit 70.

The control unit 70 may include a microprocessor or a microcontroller provided with a central processing unit (CPU) executing a plurality of computer commands to control the overall operation of the refrigerator, such as operation of compressors (not shown) forming a refrigerating cycle, the cold air supply devices and the sterilizer 100, or to achieve various control operations, for example, and include a memory device, such as a random access memory (RAM), a read only memory (ROM), or a flash memory, for example.

Figure 2:
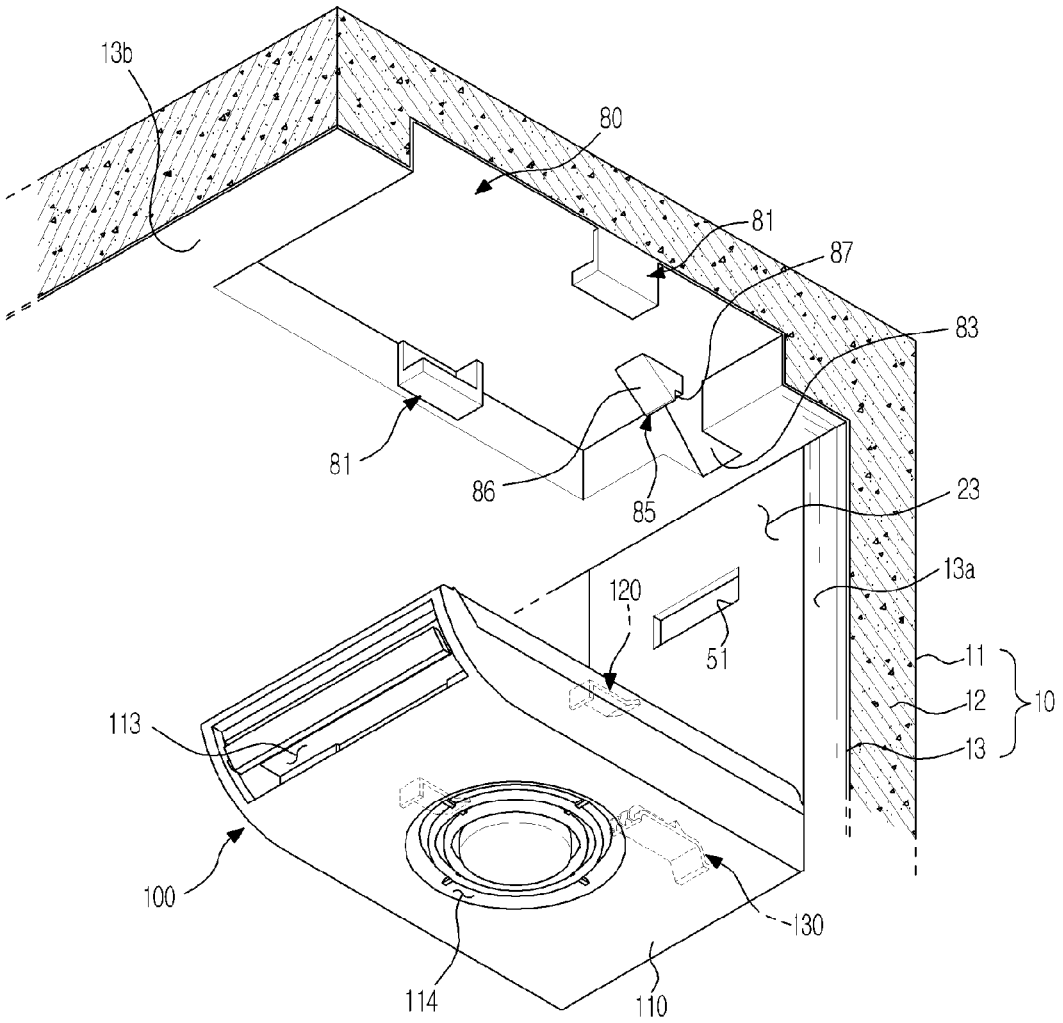
FIG. 2 is a view of a sterilizer installation part of a refrigerating chamber in accordance with the embodiment.
Figure 3:
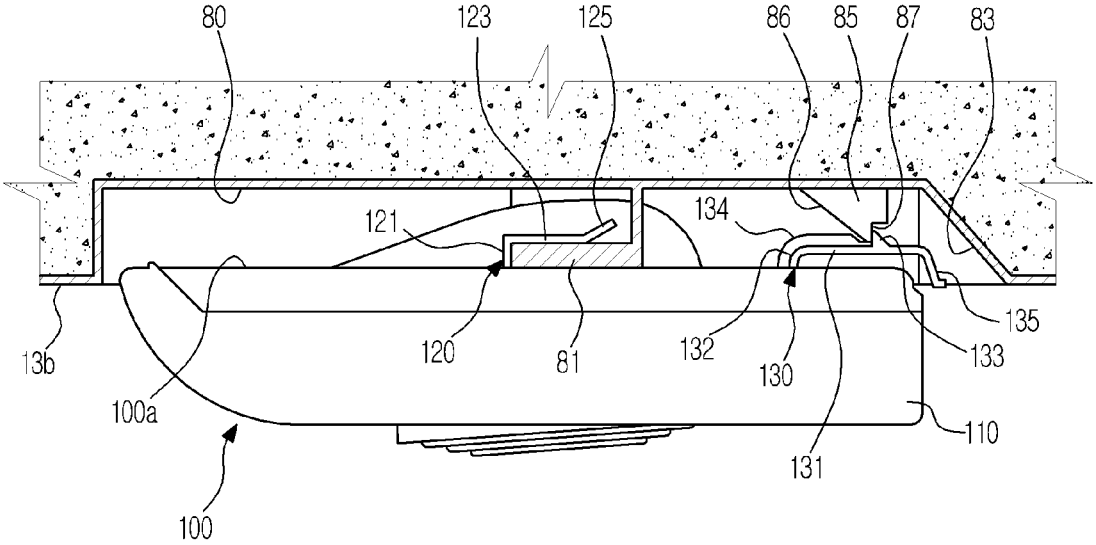
FIG. 3 is a sectional view of the refrigerating chamber in accordance with the embodiment in a state in which a sterilizer is installed in the refrigerating chamber.

FIG. 2 is a view of a sterilizer installation part of the refrigerating chamber in accordance with the embodiment, and FIG. 3 is a sectional view of the refrigerating chamber in accordance with the embodiment in a state in which the sterilizer is installed in the refrigerating chamber.

As shown in FIGS. 2 and 3, a sterilizer installation part 80 indented to a designated depth may be installed at the rear region of the upper portion of the inner case 13 forming the refrigerating chamber 23.

The sterilizer 100 includes a housing 110 having an approximately rectangular parallelepiped shape, and the housing 110 may have a slim shape having a length thereof longer than a width thereof.

The sterilizer 100 is accommodated in the concave sterilizer installation part 80, and thus an area occupied by the sterilizer 100 in the space of the refrigerating chamber 23 may be reduced and an effective volume of the refrigerating chamber 23 may be increased.

The sterilizer installation part 80 may be installed at the rear region of the upper surface of the refrigerating chamber 23 at a position adjacent to the cold air discharge holes 51 so as to allow cold air discharged from the cold air discharge holes 51 formed at the rear portion of the refrigerating chamber 23 to be easily introduced into the sterilizer 100.

Further, the sterilizer 100 may be detachably mounted in the sterilizer installation part 80 so as to be installed on the sterilizer installation part 80 or to be separated from the sterilizer installation part 80 by simple manipulation.

For this purpose, the sterilizer installation part 80 is formed in a shape corresponding to the housing 110 of the sterilizer 100, support ribs 81 protruding and extending in the forward and backward directions to support the sterilizer 100 are provided at both side walls of the sterilizer installation part 80, and a latching part 85 to restrict forward movement of the sterilizer 100, if the sterilizer 100 supported by the support ribs 81 slides toward a rear wall 13*a* of the refrigerating chamber 23 and is mounted on the sterilizer installation part 80, and is provided at the rear region of the upper surface of the sterilizer installation part 80.

Insertion ribs 120 into which the support ribs 81 formed at the sterilizer installation part 80 are inserted are provided at both sides of the upper surface of the housing 110 of the sterilizer 100, and a coupling part 130 contacting the latching part 85 and coupled with the latching part 85 after elastic deformation during sliding of the housing 110 along the support ribs 81 is provided at the rear portion of the upper surface of the housing 110.

The latching part 85 extends downwardly from the upper surface of the sterilizer installation part 80, and is formed to have a triangular cross-section having an inclined plane 86 and a vertical plane 87. The inclined plane 86 serves to guide effective entrance of the coupling part 130 and to compress the coupling part 130 to elastically deform the coupling part 130, simultaneously, and the vertical plane 87 serves to be coupled with the coupling part 130 when the coupling part 130 is returned to its original state after elastic deformation.

The coupling part 130 may include a bending plate 131 protruding from an upper surface 100*a* of the housing 110, bending and extending toward the rear wall 13*a* of the refrigerating chamber 23 so as to be elastically deformable. A hook part 133 protruding to be connected with the vertical plane 87 of the latching part 85 is provided on the upper surface of the bending plate 131, and a pressing part 135 extending downwardly in a designated shape is provided at the end of the bending plate 131.

The bending plate 131 is configured to be elastically deformable in the vertical direction with respect to a bending part 132, and the bending part 132 supplies elastic force to compress the hook part 133 upwardly. Further, reinforcing ribs 134 to increase hardness of the bending part 132 may be provided on the upper surface of the bending plate 131.

The pressing part 135 is pressed by a user, if the user desires to separate the sterilizer 100 from the sterilizer installation part 80, thereby releasing coupling between the hook part 133 and the vertical plane 87 of the latching part 85.

A finger insertion groove 83 cut to allow the user to easily press the pressing part 135 may be formed at the rear portion of the sterilizer installation part 80 opposite to the latching part 85.

The insertion rib 120 includes a vertical part 121 vertically extending from the upper surface 100*a* of the housing 110, a horizontal part 123 bending from the end of the vertical part 121 in the horizontal direction and extending so as to form a groove into which the support rib 81 is inserted, and an inclined part 125 bending upwardly and formed at the end of the horizontal part 123 so as to facilitate effective entrance of the support rib 81 into the insertion rib 120.

Through such a configuration, the sterilizer 100 in accordance with this embodiment is detachably provided on the upper surface 13*b* of the refrigerating chamber 23, thus being easily installed on the refrigerating chamber 23 and detached from the refrigerating chamber 23 without any separate tool. Further, as the sterilizer 100 is mounted in the concave-shaped sterilizer installation part 80, an ineffective space of the refrigerating chamber 23 may be reduced and thus efficiency of the volume of the refrigerating chamber 23 may be improved.

Figure 4:
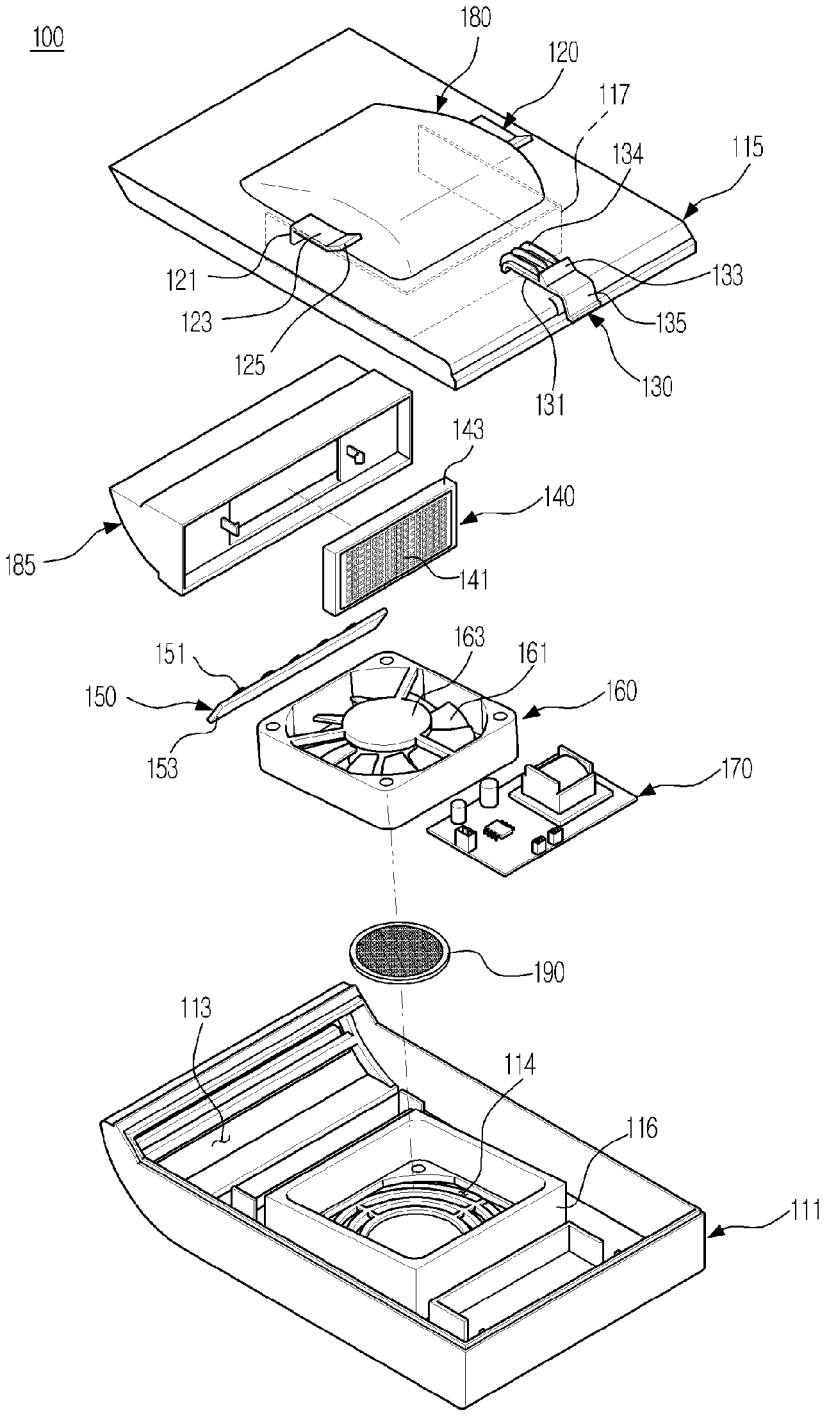
FIG. 4 is an exploded perspective view of the sterilizer in accordance with the embodiment.
Figure 5:
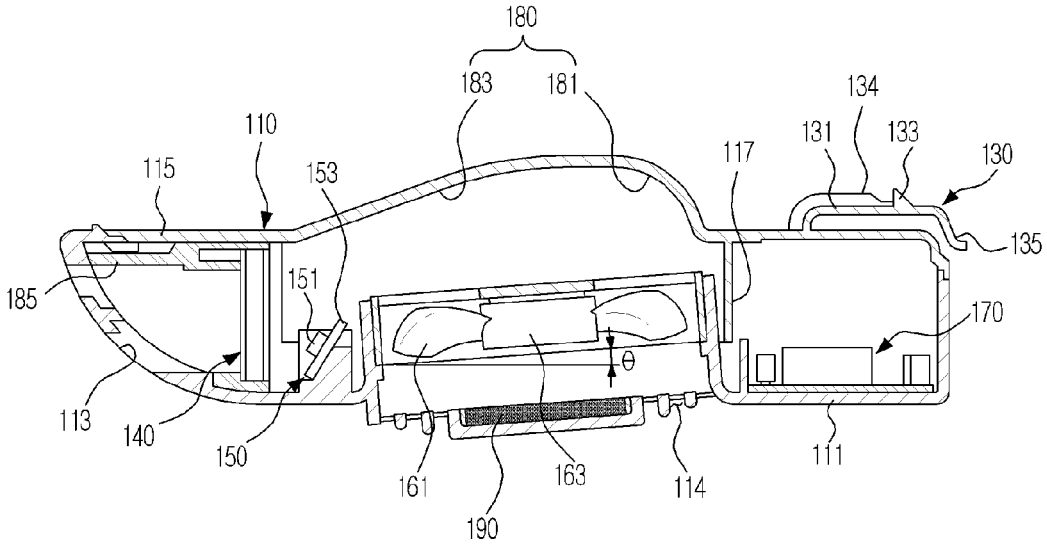
FIG. 5 is a sectional view of the sterilizer of FIG. 4 in an assembled state.

Hereinafter, the sterilizer in accordance with the embodiment will be described. FIG. 4 is an exploded perspective view of the sterilizer in accordance with the embodiment, and FIG. 5 is a sectional view of the sterilizer of FIG. 4 in an assembled state.

The sterilizer 100 in accordance with the embodiment includes the housing 110 including an upper cover 115 and a lower cover 111 connected to each other, and components to execute sterilization are installed within the housing 110.

The housing 110 has an approximately rectangular parallelepiped shape when the upper cover 115 and the lower cover 111 are connected, an ion discharge hole 113 opened in the widthwise direction is formed on the front surface of the housing 110, and an air inflow hole 114 through which external air flows into the housing 110 is formed on the lower surface of the housing 110.

An ion generation unit 140 to generate ions may be provided at the rear of the ion discharge hole 113. The ion generation unit 140 generates ions through high voltage discharge, and includes an electrode unit 141 for discharge and an insulating member 143 surrounding the edge of the electrode unit 141.

Such an ion generation unit 140 ionizes surrounding air through discharge of the electrode unit 141 by applying high voltage to the electrode unit 141.

The ions generated by the ion generation unit 140 remove harmful bacteria contained in air within the refrigerating chamber 23 or remove odors. Although this embodiment describes the ion generation unit 140 disposed vertically within the housing 110, the ion generation unit 140 may be disposed at an angle of inclination relative to the ion discharge hole 113 to reduce flow resistance of discharged air.

A light transmitting member 185 formed of a transparent material is installed at the inner circumferential surface of the ion discharge hole 113. The light transmitting member 185 transmits light emitted by a light emitting unit 150 disposed at the rear of the light transmitting member 185 to the outside through the ion discharge hole 113.

The light emitting unit 150 includes a plurality of light emitting diodes (LEDs) 151 disposed on a printed circuit board 153. Such a light emitting unit 150 serves to indicate whether or not the sterilizer 100 is operated, and light emitted by the light emitting unit 150 is transmitted to the outside through the light transmitting member 185 to produce soft lighting effects, thereby improving visibility.

An air blowing unit installation unit 116 in which an air blowing unit 160 providing suction force to suck external air through the air inflow hole 114 is installed may be provided within the lower housing 111 at a position adjacent to the air inflow hole 114.

The air blowing unit 160 sucks air from the outside of the sterilizer 100 and supplies the sucked air toward the ion generation unit 140. The air blowing unit 160 includes a fan 161 rotated by rotary force of a motor 163.

The air blowing unit 160 may be disposed at an angle of inclination in the air blowing unit installation unit 116 in consideration of flow of a refrigerant so as to effectively suck cold air discharged to cool the refrigerating chamber 23.

That is, the air blowing unit 160 may be inclined at a designated angle θ with respect to the horizontal direction (the extending direction of the upper surface of the refrigerator), i.e., inclined downwardly toward the ion discharge hole 113. This serves to enable the air blowing unit 160 to maximally coincide with the discharge direction of cold air discharged from the air discharge holes 51 formed on the rear wall 13*a* of the refrigerating chamber 23, thereby increasing an amount and a velocity of air introduced into the air inflow hole 114.

A guide unit 180 protruding outwardly to guide air discharged from the air blowing unit 160 may be provided on the upper cover 115 opposite to a discharge part of the air blowing unit 160.

The guide unit 180 guides the air discharged from the air blowing unit 160 to effectively discharge the air toward the ion discharge hole 113. The guide unit 180 includes a curved plane 181 having a designated curvature to reduce flow resistance of the discharged air, and an inclined plane 183 inclined downwardly toward the ion discharge hole 113 to accelerate the air discharged toward the ion discharge hole 113.

A shielding unit 117 extending downwardly from the upper cover 115 and surrounding the circumference of the air blowing unit 160 to prevent loss of air discharged from the air blowing unit 160 may be provided at the outside of the guide unit 180.

The front surface of the shielding unit 117 is opened to transmit air discharged through the air blowing unit 160 to the ion discharge hole 113, and the side and rear surfaces of the shielding unit 117 surround the air blowing unit 160 to prevent the discharged air from leaking.

The air inflow hole 114 may be disposed in parallel with the suction direction of air sucked by the air blowing unit 160 to reduce flow resistance of the air sucked by the inclined air blowing unit 160.

A deodorizing filter 190 formed of a porous material to which odor particles contained in air are attached may be further provided between the air blowing unit 160 and the air inflow hole 114 so as to reinforce deodorizing capacity to remove odors contained in air sucked by the air blowing unit 160.

Figure 6:
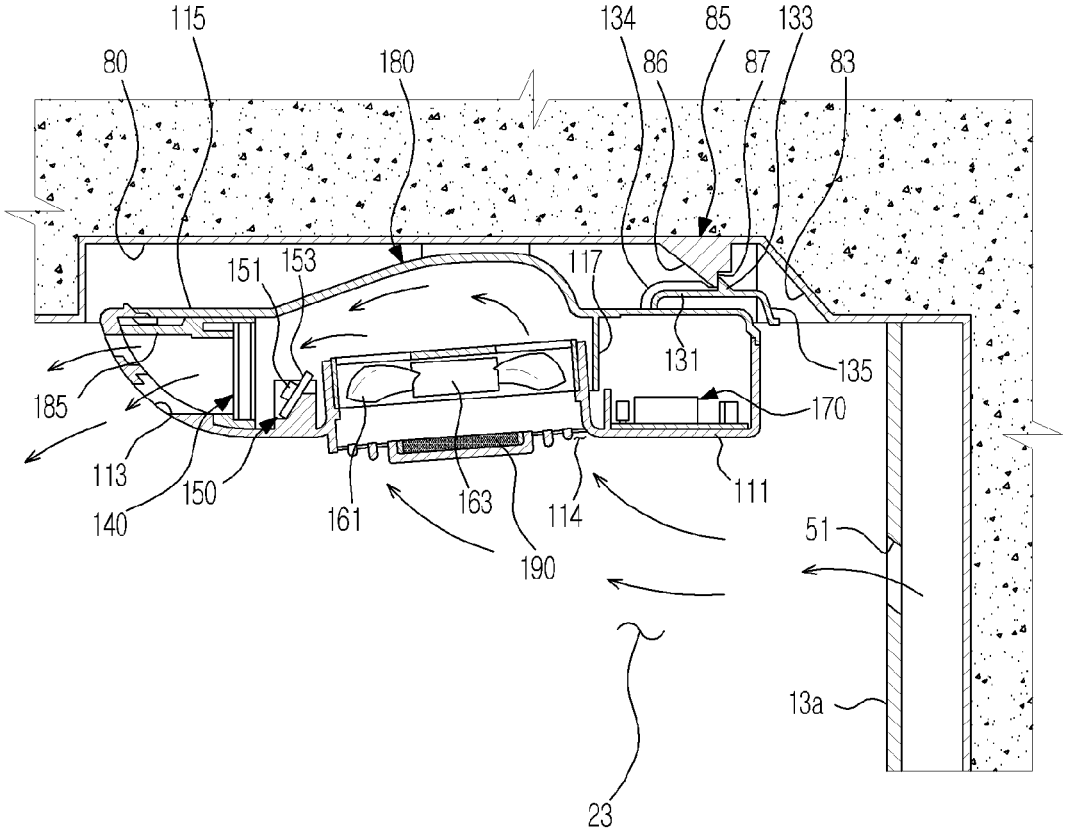
FIG. 6 is a view illustrating an ion discharge path of the sterilizer in accordance with the embodiment.

Through such a configuration, as shown in FIG. 6, cold air discharged through the cold air discharge holes 51 formed on the rear wall 13*a* of the refrigerating chamber 23 is introduced into the sterilizer 100 through the air inflow hole 114 by suction force of the air blowing unit 160 and is discharged upwardly, and the discharged air is guided by the guide unit 180 and is then discharged to the refrigerating chamber 23 through the ion discharge hole 113 together with ions generated by the ion generation unit 140.

Thereby, the cold air containing the ions discharged from the sterilizer 100 has reduced loss of the flow rate and flow velocity thereof and is spread throughout the entirety of the refrigerating chamber 23, thus improving sterilizing and deodorizing capacities.

That is, the sterilizer 100 in accordance with this embodiment allows cold air discharged through the cold air discharge holes 51 to be rapidly introduced into the sterilizer 100 and cold air discharged through the ion discharge hole 113 to be accelerated to a high flow velocity, simultaneously, thereby allowing ions generated by the ion generation unit 140 to be spread even to a distant region in the refrigerating chamber 23.

Further, a drive circuit board 170 connected to the air blowing unit 160, the ion generation unit 140, and the light emitting unit 150 to drive the air blowing unit 160, the ion generation unit 140, and the light emitting unit 150 may be provided within the housing 110.

The drive circuit board 170 is electrically connected to the control unit 70, and thus receives power and respective operating signals of the air blowing unit 160, the ion generation unit 140, and the light emitting unit 150 from the control unit 70 and operates the respective electric components of the sterilizer 100.

Figure 7:
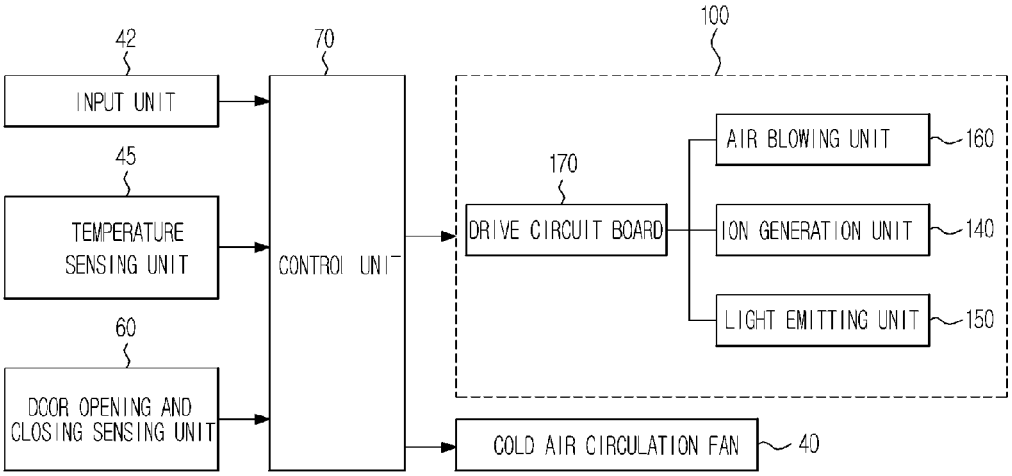
FIG. 7 is a block diagram illustrating a configuration to control operation of the refrigerator in accordance with the embodiment.

Hereinafter, operation of the refrigerator in accordance with the embodiment will be described. FIG. 7 is a block diagram illustrating a configuration to control operation of the refrigerator in accordance with the embodiment.

As shown in FIG. 7, the configuration to control operation of the refrigerator includes the input unit 42, the temperature sensing unit 45, the door opening and closing sensing unit 60, the control unit 70, the cold air circulation fan 40, and the sterilizer 100, and the sterilizer 100 includes the drive circuit board 170, the air blowing unit 160, the light emitting unit 150, and the ion generation unit 140.

The input unit 42 is electrically connected to the control unit 70, and operating signals, such as set temperatures of the refrigerator, input through the input unit 42, are transmitted to the control unit 70 and are stored in a memory device.

The temperature sensing unit 45 which is provided at one side of the storage chamber 20 senses temperatures of the inside of the storage chamber 20, converts the sensed temperature into an electrical signal, and transmits the electrical signal to the control unit 70 electrically connected to the temperature sensing unit 45.

The control unit 70 compares the temperature sensed by the temperature sensing unit 45 with the set temperature input through the input unit 42, and drives the cold air circulation fan 40 to supply cold air to the storage chamber 20 or transmits an operating signal to the sterilizer 100 according to the set temperature.

When the cold air circulation fan 40 is driven, cold air generated by the evaporator 35 passes through the cold air duct 50, is discharged through the cold air discharge holes 51, and is supplied to the storage chamber 20.

The door opening and closing sensing unit 60 senses whether or not the refrigerating chamber door 31 is opened or closed and transmits a sensing signal to the control unit 70.

The drive circuit board 170 is electrically connected to the control unit 70. Further, the drive circuit board 170 is electrically connected to the air blowing unit 160, the ion generation unit 140, and the light emitting unit 150 to control operation of the respective units 160, 140 and 150, and controls operation of the respective units 160, 140 and 150 according to a control signal of the control unit 70.

Further, the control unit 70 judges whether or not the refrigerating chamber door 31 is opened by analyzing the sensing signal of the door opening and closing sensing unit 60, and transmits an operating signal to the drive circuit board 170 according to a result of judgment as to whether or not the refrigerating chamber door 31 is opened.

Hereinafter, a control method of the refrigerator in accordance with the embodiment will be described.

The refrigerator in accordance with the embodiment may be configured to control operation of the sterilizer 100 according to a driving cycle (a refrigerating cycle or a defrosting cycle), or to control operation of the sterilizer 100 according to whether or not the doors 30 are opened or closed.

Hereinafter, operation of the sterilizer according to the driving cycle of the refrigerator will be described.

The driving cycle of the refrigerator is classified into the refrigerating cycle and the defrosting cycle. The refrigerating cycle describes a process of generating cold air through heat exchange with the evaporator 35, and the defrosting cycle describes a process of removing frost accumulated on the evaporator 35 during the refrigerating cycle using heat generated by a defrosting heater (not shown).

Humidity in the storage chamber 20 during the defrosting cycle in which frost accumulated on the evaporator 35 is evaporated by heat is higher than humidity in the storage chamber 20 during the refrigerating cycle in which cold air is generated through heat exchange. The reason for this is that the content of moisture in air increases as frost is evaporated.

Such humidity change influences the generation of ions by the ion generation unit 140. The reason for this is that mist generated due to evaporation of frost is adhered to the surfaces of electrodes of the electrode unit 141 of the ion generation unit 140 and causes change in capacitance of the electrodes and such capacitance change influences the generation of high voltage required to generate ions. Therefore, in order to control an amount of generated ions varied according to humidity change, the refrigerator in accordance with the embodiment variably controls the sterilizer 100 during the refrigerating cycle and the defrosting cycle.

Figure 8:
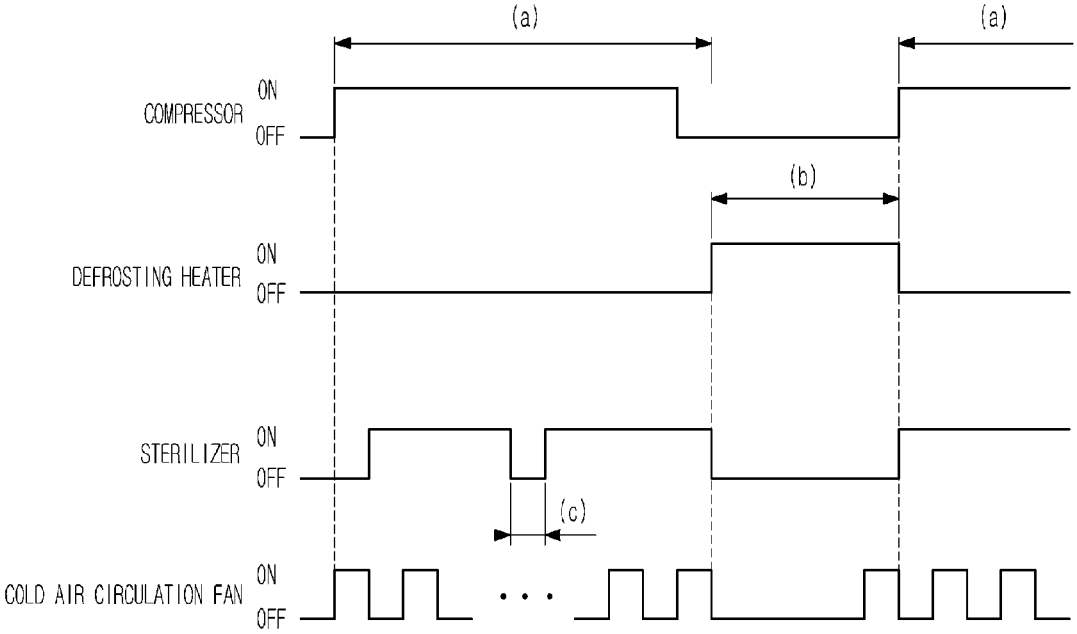
FIG. 8 is a graph illustrating operation of the sterilizer in accordance with the embodiment.

FIG. 8 is a graph illustrating operation of the sterilizer in accordance with the embodiment.

With reference to FIG. 8, the control unit 70 continuously drives the sterilizer 100 during the refrigerating cycle (a), and may execute a section (c) in which driving of the sterilizer 100 is periodically or aperiodically stopped during the refrigerating cycle. Such a stoppage section (c) may be carried out at a predetermined time after starting of the operation of the compressor.

In FIG. 8, the reason why the sterilizer 100 is not operated immediately after starting the operation of the compressor and is operated after a designated time from starting the operation of the compressor is that operation of the sterilizer 100 after a designated amount of cold air is generated and starts to be introduced into the storage chamber 100 is more effective. Further, the reason why operation of the sterilizer 100 is not stopped immediately after stoppage of operation of the compressor is that, even if operation of the compressor is stopped, cold air generated due to operation of the compressor may be introduced into the storage chamber 20.

While the sterilizer 100 is driven, the cold air circulation fan 40 is periodically turned on/off. Since cold air is generated during the refrigerating cycle (a), the sterilizer 100 is continuously driven to discharge a sufficient amount of ions together with the cold air to the storage chamber 20. At this time, the cold circulation fan 40 is periodically turned on and off so as to allow the cold air generated by the evaporator 35 to be intermittently introduced into the storage chamber 20, thereby maintaining a proper level of humidity in the storage chamber 20.

Further, the control unit 70 stops driving of the sterilizer 100 during the defrosting cycle (b) to remove frost accumulated on the evaporator 35.

Here, the control unit 70 may control driving of the sterilizer 100 such that a section in which driving of the sterilizer 100 is stopped is longer than a section in which the defrosting heater is driven during the defrosting cycle (b). That is, although the section in which driving of the sterilizer 100 is stopped may include the section in which the defrosting heater is driven, the section in which the defrosting heater is driven may be shorter than the section in which driving of the sterilizer 100 is stopped.

The reason why driving of the sterilizer 100 is stopped for a designated time or more during the defrosting cycle (b) is that humidity in the refrigerator increased due to evaporation of frost accumulated on the evaporator 35 influences ion generation of the sterilizer 100, thus decreasing an amount of generated ions and lowering driving efficiency of the sterilizer 100.

Since the defrosting cycle (b) is started from operation of the defrosting heater, the control unit 70 stops driving of the sterilizer 100 at a point of time when the defrosting heater starts to be operated. While the defrosting heater is operated, the stoppage state of the sterilizer 100 is maintained.

After operation of the defrosting heater is stopped, humidity in the storage chamber 20 is not immediately lowered to a level of humidity prior to the defrosting cycle (b). Therefore, even after operation of the defrosting heater is stopped, the sterilizer 100 is not immediately driven and the stopped state of the sterilizer 100 is maintained for a predetermined time.

When operation of the defrosting heater is stopped and driving of the compressor is restarted, the control unit 70 drives the sterilizer 100 again. When driving of the compressor restarted, the refrigerating cycle (a) is restarted, and thus the above-described method of controlling the sterilizer 100 during the refrigerating cycle (a) is carried out.

During the defrosting cycle (b), a time for which driving of the sterilizer 100 is stopped and a point of time when operation of the compressor is restarted may be set as a time for which an amount of ionized water in the storage chamber 20 is maintained at a predetermined level and a point of time when the amount of the ionized water in the storage chamber 20 is decreased to less than the predetermined level. Hereinafter, operation of the sterilizer 100 will be described based on an operating state of the refrigerating chamber door 31 to open and close the refrigerating chamber 23.

First, the control unit 70 receives a sensing signal from the door opening and closing sensing unit 60 to sense whether or not the refrigerating chamber door 31 is opened or closed, and judges whether or not the refrigerating chamber door 31 is opened or closed through the sensing signal.

Upon judging that the refrigerating chamber door 31 is opened, the control unit 70 turns power of the light emitting unit 150 on through the drive circuit board 170 of the sterilizer 100 in order to indicate normal operation of the sterilizer 100 and obtain visibility of the sterilizer 100, and stops operation of the air blowing unit 160 and the ion generation unit 140 to prevent energy loss due to cold air leakage, simultaneously.

On the other hand, upon judging that the refrigerating chamber door 31 is closed, the control unit 70 turns power of the light emitting unit 150 off through the drive circuit board 170 and operates the air blowing unit 160 and the ion generation unit 140 to sterilize and deodorize the inside of the refrigerating chamber 23, simultaneously.

At this time, although the control unit 70 may continuously operate the air blowing unit 160 and the ion generation unit 140*d*, the control unit 70 may operate the air blowing unit 160 and the ion generation unit 140 only for a designated time or intermittently operate the air blowing unit 160 and the ion generation unit 140 so as to reduce energy consumption.

As is apparent from the above description, a refrigerator in accordance with one embodiment variably controls a sterilizer during refrigerating operation and defrosting operation, thereby exhibiting uniform sterilizing and deodorizing capacities regardless of variation in humidity.

Further, ions generated by the sterilizer are uniformly distributed in a storage chamber, thereby improving sterilizing and deodorizing capacities.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A refrigerator comprising: at least one storage chamber including a recess in a substantially horizontal upper surface in the at least one storage chamber, the recess including horizontal support ribs; an evaporator configured to generate cold air to cool the at least one storage chamber; a cold air circulation fan configured to forcibly circulate the cold air generated by the evaporator; a defrosting heater configured to heat the evaporator to remove frost accumulated on the evaporator; a detachable sterilizer configured to sterilize and deodorize the inside of the at least one storage chamber; and a control unit configured to drive the sterilizer based on a humidity level in the refrigerator while repeatedly turning the cold air circulation fan on and off during a refrigerating cycle in which the defrosting heater is not operated, and configured to stop driving the sterilizer during operation of the defrosting heater such that the sterilizer is driven during a first period of a first humidity level and the defrosting heater is operated during a second period of a second humidity level, wherein the second humidity level is greater than the first humidity level.

2. The refrigerator according to claim 1, wherein the control unit executes a section in which driving of the sterilizer is periodically or aperiodically stopped during operation of the sterilizer.

3. The refrigerator according to claim 1, wherein the control unit continuously drives the sterilizer during the refrigerating cycle in which the defrosting heater is not operated.

4. A refrigerator comprising:

at least one storage chamber including a recess in a substantially horizontal upper surface in the at least one storage chamber, the recess including horizontal support ribs;

an evaporator configured to generate cold air to cool the at least one storage chamber;

a cold air circulation fan configured to forcibly circulate the cold air generated by the evaporator; a defrosting heater configured to heat the evaporator to remove frost accumulated on the evaporator;

a detachable sterilizer configured to sterilize and deodorize the inside of the at least one storage chamber; and a control unit configured to drive the sterilizer based on a humidity level in the refrigerator while repeatedly turning the cold air circulation fan on and off during a refrigerating cycle in which the defrosting heater is not operated, and configured to periodically or aperiodically stop the driving the sterilizer during operation of the sterilizer, such that the sterilizer is driven during a first period of a first humidity level and the defrosting heater is operated during a second period of a second humidity level, wherein the second humidity level is greater than the first humidity level.

5. The refrigerator according to claim 4, wherein the control unit stops driving of the sterilizer during operation of the defrosting heater.

6. A refrigerator comprising:

at least one storage chamber including a recess in a substantially horizontal upper surface in the at least one storage chamber, the recess including horizontal support ribs;

an evaporator configured to generate cold air to cool the at least one storage chamber;

a cold air circulation fan configured to forcibly circulate the cold air generated by the evaporator; a defrosting heater configured to heat the evaporator to remove frost accumulated on the evaporator;

a detachable sterilizer configured to sterilize and deodorize the inside of the at least one storage chamber; and a control unit configured to drive the sterilizer based on a humidity level in the refrigerator while repeatedly turning the cold air circulation fan on and off during a refrigerating cycle in which the defrosting heater is not operated, and configured to stop driving the sterilizer during operation of the defrosting heater based on a humidity level in the refrigerator;

such that the sterilizer is driven during a first period of a first humidity level and the defrosting heater is operated during a second period of a second humidity level, wherein the second humidity level is greater than the first humidity level.

7. The refrigerator according to claim 6, wherein the sterilizer comprises an ion generator, an air blower, and a light emitter.

8. The refrigerator according to claim 6, wherein the sterilizer is detachable from the refrigerator by releasing the latch.

9. The refrigerator according to claim 6, wherein the sterilizer is mounted in a concave installation space.

10. The refrigerator according to claim 6, wherein the sterilizer is mounted in a position adjacent to cold air discharge holes.

* * * * *